US005109927A

United States Patent [19]

Supernaw et al.

[11] Patent Number: 5,109,927

[45] Date of Patent: May 5, 1992

[54] RF IN SITU HEATING OF HEAVY OIL IN COMBINATION WITH STEAM FLOODING

[76] Inventors: Irwin R. Supernaw, P.O. Box 430, Bellaire, Tex. 77402-0430; Kerry D. Savage, 9130 Olathe, Houston, Tex. 77055

[21] Appl. No.: 648,691

[22] Filed: Jan. 31, 1991

[51] Int. Cl.[5] ..... E21B 43/24

[52] U.S. Cl. ..... 166/248; 166/272

[58] Field of Search ..... 166/248, 303, 272, 60

[56] References Cited

U.S. PATENT DOCUMENTS 3,848,671 11/1974 Kern ..... 166/248

4,140,180 2/1979 Bridges et al. ..... 166/248

4,456,065 6/1984 Heim et al. ..... 166/248

4,545,435 10/1985 Bridges et al. ..... 166/248

4,926,941 5/1990 Glandt et al. ..... 166/272 X

*Primary Examiner*—Stephen J. Novosad

*Attorney, Agent, or Firm*—Jack H. Park; Kenneth R. Priem; Russell J. Egan

[57] ABSTRACT

A subterranean hydrocarbon-bearing formation is preheated by application of RF energy to the formation so that subsequent steam flooding will more effectively sweep the hydrocarbons from the formation without steam override occurring.

7 Claims, 1 Drawing Sheet

RF IN SITU HEATING OF HEAVY OIL IN COMBINATION WITH STEAM FLOODING

BACKGROUND OF THE INVENTION

1. The Field of the Invention

The present invention relates to a method and apparatus for recovery of hydrocarbons from a reservoir by steam flooding and in particular to a method and apparatus which will reduce steam override thereby providing a cleaner steam sweep of the reservoir.

2. The Prior Art

Steam flooding has become an accepted practice for the recovery of heavy petroleum from fields or reservoirs that require a thermal stimulation to produce a satisfactory flow of crude. There is a need for a simple method to assure that the reservoir will be completely flooded with the steam. In the usual scenario the steam entering the formation from an injection well will tend to rise towards the surface as it moves out through the formation from the injection well. The further out the steam travels from the injection well, the further up towards the surface it will flow. When the steam encounters an extraction well, it will be at a shallower depth than the point at which it was injected. This is called steam override and leaves a portion of the formation still containing hydrocarbons which cannot be recovered by further steam injection since any additional steam would merely follow the previously swept path.

SUMMARY OF THE INVENTION

The present invention uses directed RF energy to preheat a specific bottom level portion of a formation prior to or simultaneously with steam flooding of the formation so that the steam in the subsequent flood will follow the preheated, more permeable path. The RF energy can be radiated with the formation from either an injection well or a production well or combination of wells. The RF energy is preferably directed to uniformly heat the bottom of the reservoir for total hydrocarbon recovery.

BRIEF DESCRIPTION OF THE DRAWINGS

The present invention will be described by way of example with reference to the accompanying drawings in which.

DETAILED DESCRIPTION OF THE PRESENT INVENTION

Figure 1:
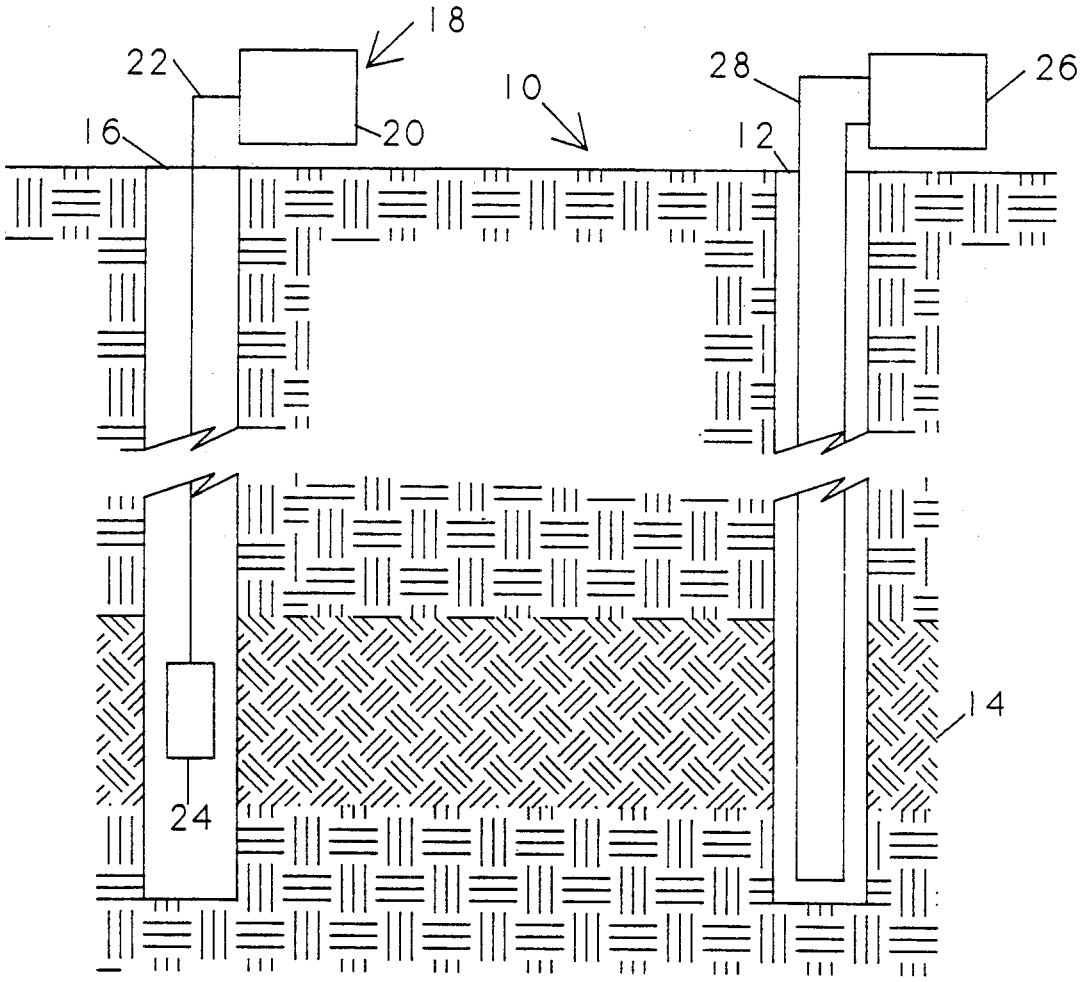
FIG. 1 is a schematic representation of the subject invention.

The single FIGURE is a schematic representation of a vertical section through a typical production field that is going to be subject to steam flooding. The field 10 has at least one steam injection well 12 penetrating the formation 14, which is the formation to be steam flooded. Spaced from and forming a patterned array around each steam injection well are a plurality of producing wells 16, each of which also penetrates the formation 14. An RF application system 18 includes an RF source 20 with coaxial cable means 22 coupled thereto and antenna means 24 connected on the free end of the cable means. The cable and antenna portion of the system are lowered into a selected producing or injection well and energized to generate RF energy which is directed into the formation causing it to heat. The amount of heating achieved will be dependent upon many things, such as the porosity and fluid content of the formation as well as the power and frequency of the RF energy generated. The subsequent steam flooding of the formation by injection of the steam from the source 26 into the injection well 12 by piping 28 will be enhanced in that the steam will tend to follow the preheated, more permeable portion of the formation further out into the formation prior to commencing to rise towards the surface. As the steam flooding continues, the steam will rise to the top of the formation thereby cleaning it of substantially all of the hydrocarbons contained therein.

The present invention contemplates directing RF energy preferably into the lower part of the hydrocarbon-filled formation, normally, but not necessarily, prior to application of the steam in a steam flooding operation. The simplest configuration would apply RF energy to a lower part of the formation using an antenna suspended in a producing well during a current steam flood operation, preferably during the early part of the life of the flood. The RF energy would heat the formation thereby decreasing the permeability to reduce the problem of steam override. However, the potential value of the RF enhancement would be much greater if the lower part of the formation is initially preheated using RF application in the injection well. The steam would then have a more permeable path near the bottom of the formation for the initial introduction of steam. Simultaneously, or later in the early stages of steam flooding, RF could also be applied to producing wells or additional applicator wells to preferentially heat the lower regions of the formation from several directions around the injection well. The RF applicators would be designed to direct the energy in a beam as narrow as possible in the vertical plane in order selectively direct the energy only into the lower portion of the formation. The beam, in the horizontal plane, could be of any width since that is the desired heating plane. By using multiple applicators in multiple wells, and with proper phasing of the RF energy, it would be possible to steer the heating pattern into various areas of the formation with the objective of uniformly heating the bottom of the formation throughout the horizontal plane. With the selective preheating of the lower part of the formation, the steam flood will begin at the bottom and work its way up and will thereby, more effectively sweep the entire reservoir.

It may be desirable, in practicing the present invention, to use RF applicator holes in addition to steam injection and producing wells. This does not negate the principles of this invention but may affect the economics of such a project. The necessity of the extra holes may arise as the formation gets thinner and the intended beam width, in the vertical plane gets wider and the RF power level gets smaller.

While the present invention does not envision a particular RF applicator device, there already exists an substantial number of suitable devices which could be adapted to perform the present invention. For example, U.S. Pat. No. 4,700,716 shows a microwave colinear antenna-array applicator which is highly directional and is used to heat tumors. The principles involved in this prior art device could be readily adapted for use with the present invention.

The present invention may be subject to many modifications and changes without departing from the spirit or essential characteristics of the invention as defined by the appended claims.

We claim:

1. A method for producing hydrocarbons from a subterranean formation comprising the steps of:

penetrating the formation with a plurality of bore holes in a patterned array;

lowering into at least one of said bore holes RF generating means capable of penetrating the formation with RF energy in a narrow vertical but wide horizontal bend and preheating only the lower portion of the adjacent formation by application thereto of said RF energy independent of any other RF source; and flooding the preheated area of the formation with steam.

2. A method according to claim 1 wherein the RF preheating is accomplished from a production well.

3. A method according to claim 1 wherein the RF heating is accomplished from a steam injection well.

4. A method according to claim 1 wherein the RF heating is accomplished from a production well during the course of steam flooding.

5. A method according to claim 1 wherein the RF heating is accomplished from a plurality of production wells forming a patterned array around an injection well.

6. A method according to claim 1 wherein the RF heating is accomplished first from an injection well and then from production wells forming a patterned array around the injection well.

7. A method according to claim 6 wherein the RF heating from the injection well is prior to steam flooding and the RF heating from the production wells is no later than in the early stages of steam flooding.

* * * * *